US011065673B2

(12) United States Patent
Pereira Teixeira Mendes

(10) Patent No.: US 11,065,673 B2
(45) Date of Patent: Jul. 20, 2021

(54) HOT STEEL FORGING IN HORIZONTAL PRESS

(71) Applicant: TECNIFORJA—FORJAGEM E ESTAMPAGEM DE PEÇAS TÉCNICAS, LDA, Serrinha-LIXA FLG (PT)

(72) Inventor: Artur José Pereira Teixeira Mendes, Vila Verde FLG (PT)

(73) Assignee: TECNIFORJA—FORJAGEM E ESTAMPAGEM DE PEÇAS TÉCNICAS, LDA, Serrinha-LIXA FLG (PT)

( * ) Notice: Subject to any disclaimer, the term of this patent is extended or adjusted under 35 U.S.C. 154(b) by 625 days.

(21) Appl. No.: 15/565,312

(22) PCT Filed: Apr. 11, 2016

(86) PCT No.: PCT/IB2016/052050

§ 371 (c)(1),
(2) Date: Oct. 9, 2017

(87) PCT Pub. No.: WO2016/162857

PCT Pub. Date: Oct. 13, 2016

(65) Prior Publication Data

US 2018/0056369 A1 Mar. 1, 2018

(30) Foreign Application Priority Data

Apr. 10, 2015 (PT) ..... 108355

(51) Int. Cl.
*B21K 21/12* (2006.01)
*B21J 1/06* (2006.01)
(Continued)

(52) U.S. Cl.
CPC ..... *B21J 5/022* (2013.01); *B21J 1/06* (2013.01); *B21J 5/08* (2013.01); *B21K 1/063* (2013.01); *B21K 1/765* (2013.01); *B21K 21/12* (2013.01); *C21D 1/28* (2013.01); *C21D 1/84* (2013.01); *C21D 7/13* (2013.01); *C21D 9/08* (2013.01)

(58) Field of Classification Search
None
See application file for complete search history.

(56) References Cited

U.S. PATENT DOCUMENTS

| | | | |
|---|---|---|---|
| 4,380,480 | A | 4/1983 | Delfino et al. |
| 2002/0160844 | A1 | 10/2002 | Ginsberg et al. |
| 2004/0021289 | A1 | 2/2004 | Wu |

FOREIGN PATENT DOCUMENTS

| | | |
|---|---|---|
| CN | 102896171 | 1/2013 |
| DE | 3742717 | 2/1989 |

(Continued)

OTHER PUBLICATIONS

Davis, J.R. "Forging." Metals Handbook Desk Edition, Second Edition. pp. 839-863. 1998. (Year: 1998).*

(Continued)

*Primary Examiner* — Brian D Walck
(74) *Attorney, Agent, or Firm* — Leason Ellis LLP

(57) ABSTRACT

The present disclosure relates to a steel forging process, in particular a hot steel forging process in horizontal press of a metal tube, preferably a cylindrical steel tube.

7 Claims, 6 Drawing Sheets

(51) Int. Cl.

| | |
|---|---|
| ***C21D 1/84*** | (2006.01) |
| ***C21D 7/13*** | (2006.01) |
| ***C21D 9/08*** | (2006.01) |
| ***C21D 1/28*** | (2006.01) |
| ***B21J 5/08*** | (2006.01) |
| ***B21J 5/02*** | (2006.01) |
| ***B21K 1/76*** | (2006.01) |
| ***B21K 1/06*** | (2006.01) |

(56) References Cited

FOREIGN PATENT DOCUMENTS

| | | |
|---|---|---|
| EP | 0941783 | 9/1999 |
| GB | 1377046 | 12/1974 |
| GB | 2331721 | 6/1999 |
| KR | 20140014505 | 2/2014 |
| SU | 1375391 | 2/1988 |

OTHER PUBLICATIONS

Hyuk-Hong Kwon et al, "Forging Process Analysis of the Multi-forging Die for the Unified Universal Pipe Joint of the Intermediate Shaft", Journal of the Korean Society of Manufacturing Technology Engineers vol. 9 No. 1, (Jan. 1, 2010), pp. 33-41.

* cited by examiner

HOT STEEL FORGING IN HORIZONTAL PRESS

CROSS-REFERENCE TO RELATED PATENT APPLICATIONS

This application is a U.S. National Phase Application under 35 U.S.C. § 371 of International Patent Application No. PCT/IB2016/052050, filed Apr. 11, 2016, and claims the priority of Portuguese Patent Application No.: 108355, filed Apr. 10, 2015, each of which is incorporated by reference as if expressly set forth in their respective entirety herein.

TECHNICAL FIELD

The present disclosure relates to a steel forging process, in particular a hot steel forging process in horizontal press of a metal tube, preferably a cylindrical steel tube.

BACKGROUND

The best existing solution to date for obtaining a part is through a hot forging process in vertical press, from a solid steel rod.

This solution requires a subsequent deep machining operation, which is time-consuming and more expensive, in order to obtain the part for final application.

These facts are disclosed to illustrate the technical problem solved by the present disclosure.

GENERAL DESCRIPTION

The main objective of the present disclosure is to introduce developments in the technology for obtaining a forged part from a metal tube, preferably a cylindrical steel tube.

The traditional forging process is a hot forging process in vertical press and is based on the following: cutting the raw material into the length necessary for obtaining the desired part; heating the solid steel rod; hot forging of the solid steel rod in a vertical press; deburring so as to remove the scrap from the part; heat treatment for imparting the necessary mechanical properties and deep drilling of the part in order to obtain the final part.

The raw material in the traditional forging process (hot forging in vertical press) is a solid steel rod, whereupon this process requires deep machining procedures. These deep machining procedures are time-consuming, costly and responsible for products of inferior characteristics, particularly medium and low quality products.

In contrast, the present disclosure describes a faster, lasting and less expensive solution compared to the traditional forging process (hot forging in vertical press). The present disclosure describes obtaining a part with a specific geometry from a tube using a hot steel forging process in horizontal press.

This disclosure allows using a tube, preferably a cylindrical steel tube as raw material, as opposed to a solid steel rod as used in the traditional process (hot steel forging process in vertical press). This tube, preferably a cylindrical steel tube, can be cut into the required length to produce the part, being subsequently molded, wherein the diameter, or the thickness, or the diameter and thickness of the final part is 1.5-2.5 times the diameter, or thickness, or diameter and thickness of the starting tube, without ruptures or defects in the final part, the variation of 1.5-2.5 times not being related to the length of the tube, since said tube is cut according to the length required to produce the part.

By tube, pipe or conduit, is meant a long hollow metal cylinder (although it may have other shapes, such as a rectangular shape, for example). It may vary in diameter, wall thickness and length, wherein diameter is meant as the outer diameter.

This disclosure allows obtaining a resistant and structurally stable final part from a tube, with the following steps: partially heating the tube, preferably a cylindrical steel tube, and subsequently subjecting thereof to two or more deformations (stamping) in horizontal press forging; deburring to remove the scrap from the part, if need be; controlled cooling the part at room temperature and finally finishing processes such as turning the tube into the desired final configuration.

In the present disclosure, a tube is generally understood as a long hollow cylinder—although it may have other shapes, such as a rectangular shape and is made of metal. It may vary in diameter, thickness, or in diameter and thickness.

In a first stage of the hot steel forging process in horizontal press, a tube, preferably a cylindrical steel tube, undergoes a partial heating process done in an electric induction oven. Subsequently to the partial heating process of the tube, preferably a cylindrical steel tube, it is subjected to three different deformations (stamping). Finally, the part is cooled in a controlled manner in order to impart the required mechanical properties to the final part and the forged part is obtained with a geometry very similar to that of the semi-finished part, which highly reduces the subsequent machining operation.

All stages of the hot steel forging process in horizontal press are characterized by the production of the final part made with integrated control heating and from a tube, preferably a cylindrical steel tube.

The advantages of the present disclosure are:

- the flow of raw material fibers is not interrupted, that is, the moving of the fibers in the direction of their positioning within the raw material, which provides the part with greater stability and less tensioning therein;
- the subsequent machining process is considerably more cost-effective with lower cycle times and more cost-effective tools;
- the equipment required for this operation itself will not have to be as robust, given the decrease in efforts necessary for this purpose;
- handling the forged part is easier and more practical, since with this process the forged part weighs about 50% less than that obtained by the traditional process;
- the forging equipment necessary to execute the part by the novel hot steel forging process in horizontal press does not require as much power and capacity when compared to the traditional process, since the projected area is much smaller, so the hot steel forging process in horizontal press is cheaper and faster to be amortized;
- decrease in raw material consumption.

By the facts listed above, the present disclosure provides wide application in steel part forging world industry and is intended at obtaining parts from a tube with a specific conformation, while maintaining the same mechanical properties as the parts obtained by other processes—namely from solid rods—and while being at the same time lighter in weight.

The present application relates to a forge process or forging process, which aims at modifying the shape of the metal tube, in particular a cylindrical steel tube, wherein a portion of the obtainable part has a diameter, or a thickness, or a diameter and thickness between 1.5-2.5 times the diameter, thickness, or diameter and thickness of the metal tube. The process referred to in this disclosure comprises the following steps:

- heating a portion of the metal tube meant to be changed in shape;
- pressing the heated portion for bringing the heated portion closer to a pre-defined geometry of the part to be obtained;
- subjecting the heated and pressed portion of the part to a second pressing for obtaining the portion of the part to be obtained with the pre-defined geometry of the part to be obtained;
- wherein the pre-defined geometry of the part to be obtained has a portion of the part to be obtained with between 1.5-2.5 times the diameter, or thickness, or the diameter and thickness, of the metal tube.

In an embodiment, the part to be obtained may be a sleeve yoke, namely of trucks.

In an embodiment, the forging process can further comprise a third or fourth pressing of the part.

In an embodiment, the press is a horizontal-type press.

In an embodiment, the portion of the part to be obtained by forging process can be between 1.8-2.3 times the diameter, or thickness, or the diameter and thickness of the metal tube, preferably 1.9 times the diameter, or thickness, or the diameter and thickness of the metal tube; 2 times the diameter, or thickness, or the diameter and thickness of the metal tube; 2.1 times the diameter, or thickness, or the diameter and thickness of the metal tube; 2.2 times the diameter, or thickness, or the diameter and thickness of the metal tube.

In an embodiment, the metal tube is a cylinder.

In an embodiment, the metal tube is a steel tube.

In an embodiment, the forging process may further comprise partial heating the tube, preferably a cylindrical steel tube, at a temperature between 1300° C. and 1400° C., preferably between 1340 and 1360° C.

In an embodiment, partial heating of the tube, preferably a cylindrical steel tube, can be done in an electric induction oven.

In an embodiment, the forging of the cylindrical steel tube can be partially heated which is carried out in 180 seconds, preferably 120 seconds, preferably 60 seconds, preferably 30 seconds, preferably 15 seconds.

In an embodiment, the forging process can further comprise a controlled cooling of the metal tube, preferably of the cylindrical steel tube, in particular using temperature ramps in particular at a temperature between 900-1000° C. to room temperature, with a conveyor belt speed of about 8 m/h and an air flow rate of about 200 $m^3$/h.

In an embodiment, the forging process can further comprise passing the part through a cooling tunnel with a speed variation of the conveyor belt and a flow rate variation of forced air passing therethrough, so as to promote the controlled cooling of the metal tube, in particular a cylindrical steel tube. The conveyor belt speed may vary particularly between 5-20 m/h, preferably 10-15 m/h and the flow rate of air charged inside the tunnel can vary between 100-300 $m^3$/h, preferably 120-290 $m^3$/h, and combinations thereof.

The present application further describes a part obtainable by the forging process described from a tube, preferably a cylindrical steel tube, wherein the final part has mechanical characteristics equivalent to those of parts obtained from solid rods.

In an embodiment, the part to be obtained is a part for an automobile, particularly for a truck; wherein said part may be an axle, a semi-axle of an automobile, or a sleeve yoke, in particular of trucks.

In an embodiment, the part to be obtained may comprise a weight between 0.150-40 kg.

Throughout the specification and claims the word "comprising" and variations thereof, are not intend to exclude other technical features, components, or steps. Additional objects, advantages and features of the disclosure will become apparent to those skilled in the art upon examination of the specification, or may be learned upon practice of the disclosure. The following examples and drawings are provided by way of illustration and are not intended to be limiting of the present disclosure. Furthermore, the present disclosure covers all possible combinations of particular or preferred embodiments herein described.

BRIEF DESCRIPTION OF THE DRAWINGS

For an easier understanding of the solution, drawings are herein attached, which represent preferred embodiments of the disclosure and which, however, are not intended to limit the scope of the present disclosure.

FIG. 3: Side perspective of the starting cylindrical steel tube, wherein:

1 represents the tube area subject to heating;

2 represents the tube area not subject to heating.

Figure 1:
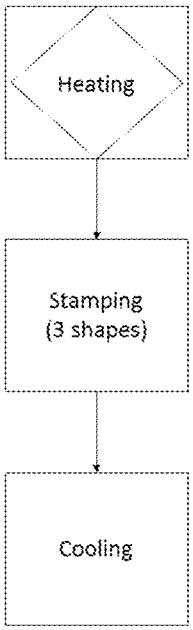
FIG. 1: Flowchart of the hot steel forging process in horizontal press.
Figure 2:
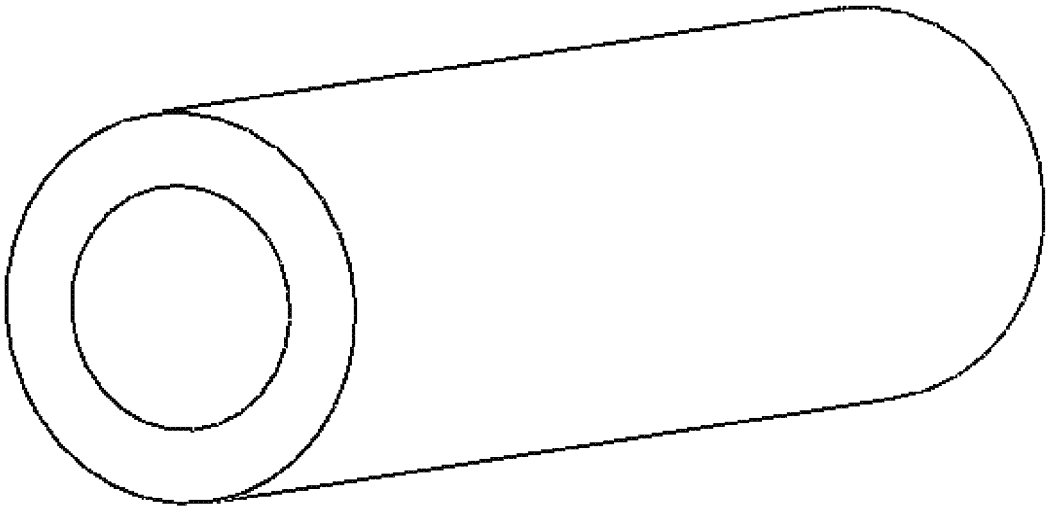
FIG. 2: Side perspective of the starting cylindrical steel tube.
Figure 3:
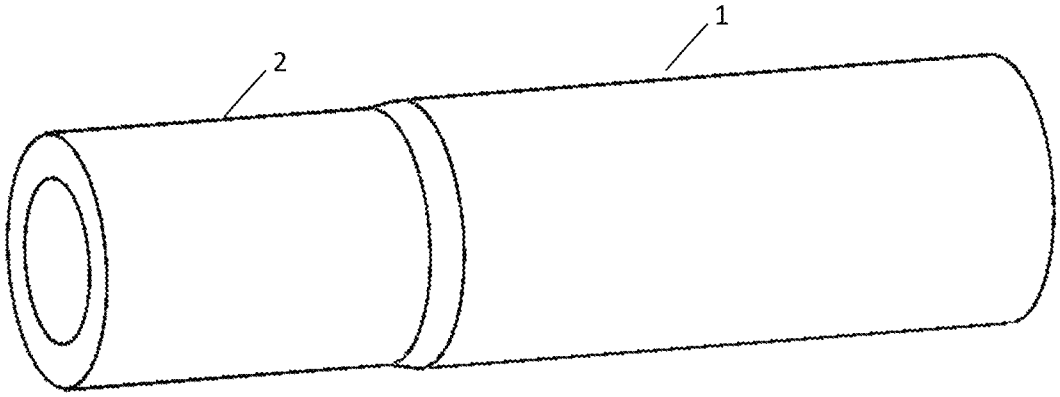
Figure 4:
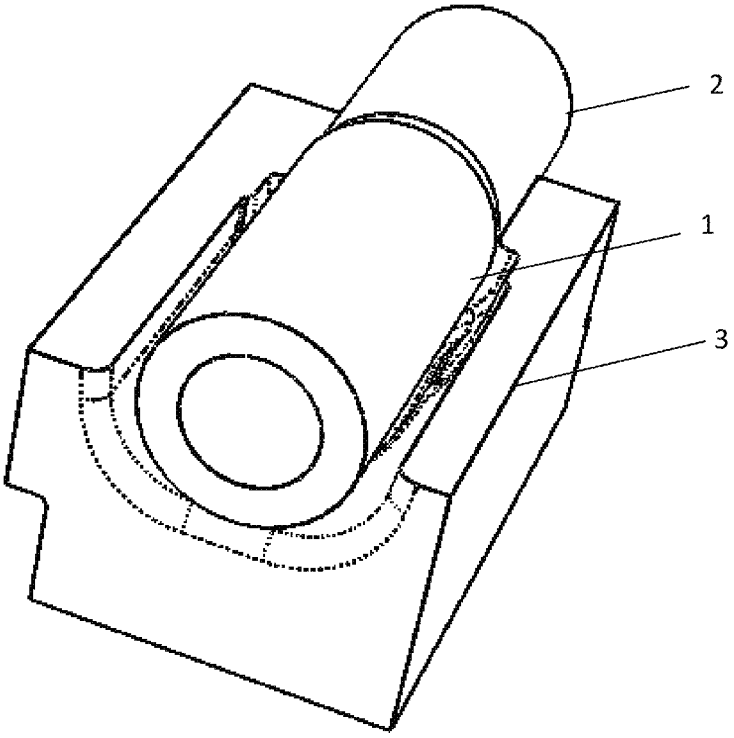

FIG. 4: Side perspective of the cylindrical steel tube placed inside the die with the heated cylindrical steel tube wherein: 3 represents the die.

Figure 5:
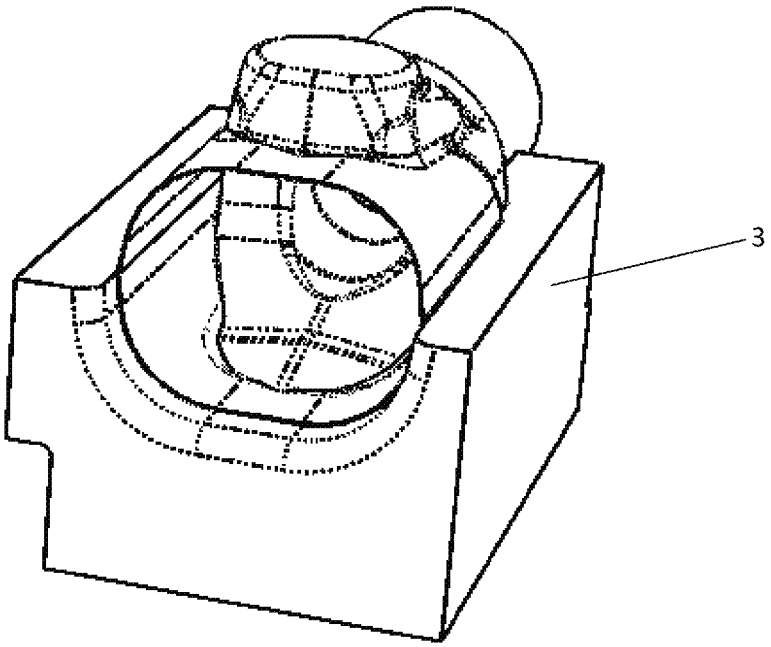

FIG. 5: Front perspective of the die with preform.

Figure 6:
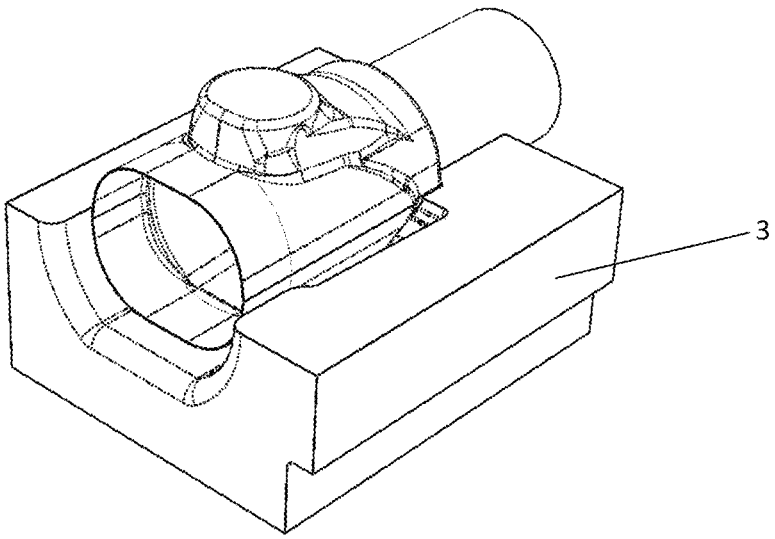

FIG. 6: Top side perspective of the final die with preform.

Figure 7:
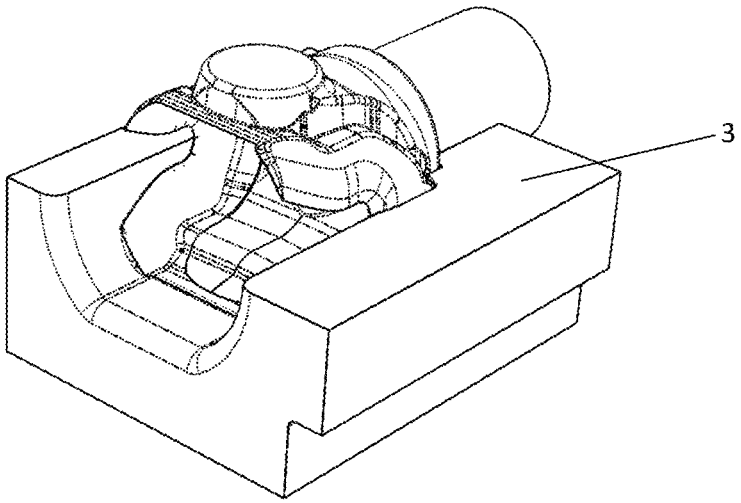

FIG. 7: Top side perspective of the final part with final part.

Figure 8:
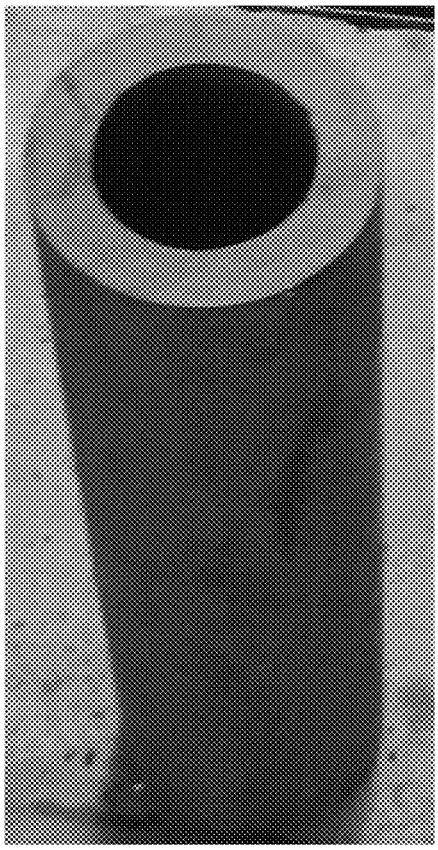

FIG. 8: Top perspective of the starting cylindrical steel tube.

Figure 9:
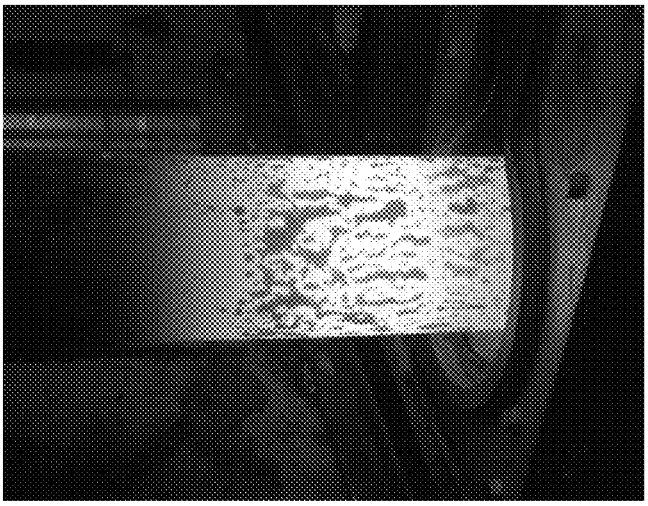

FIG. 9: Side perspective of the heated starting cylindrical steel tube.

Figure 10:
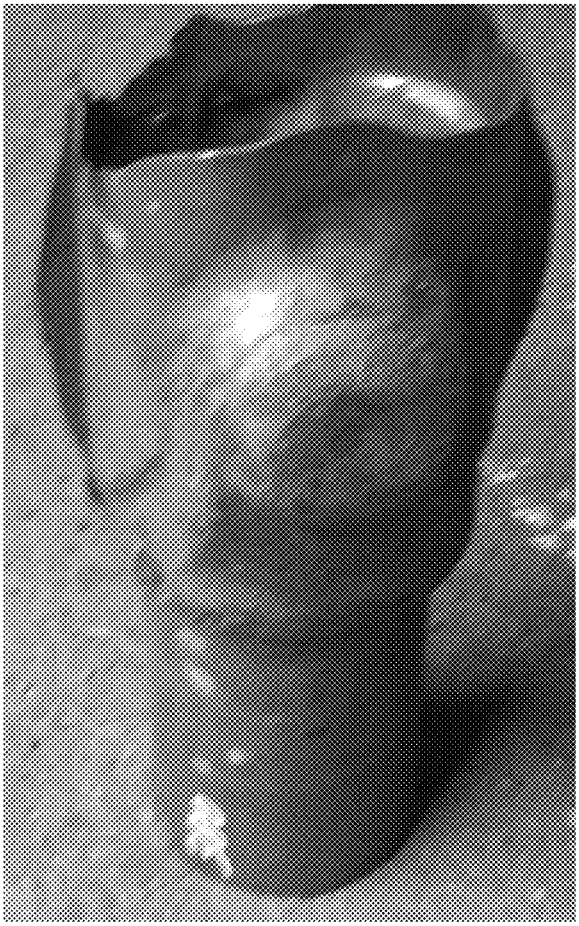

FIG. 10: Side perspective of the tube with the second preform.

Figure 11:
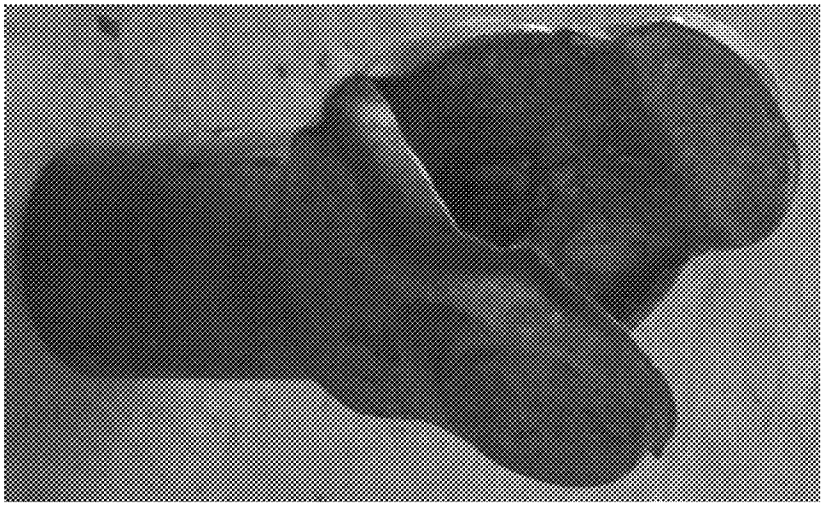

FIG. 11: Side perspective of the final tube with burr.

Figure 12:
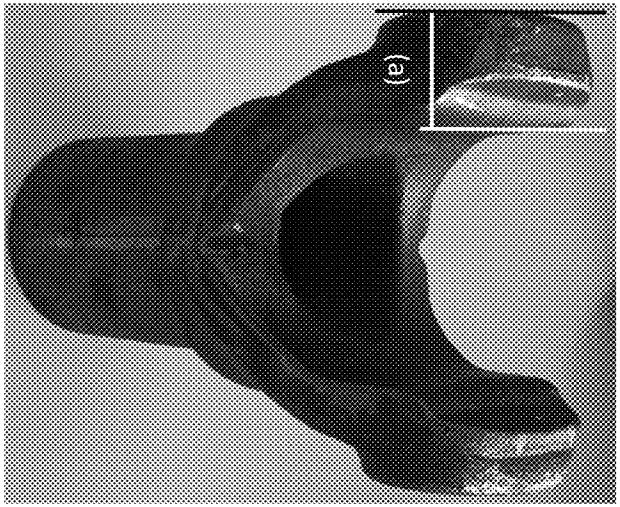

FIG. 12: Side perspective of the tube without burr wherein (a) represents the thickness of the part obtained after the herein disclosed forging process.

DETAILED DESCRIPTION

Obtaining a part by a hot steel forging process in horizontal press, wherein the obtained part does not need machining and is not cracked, is carried out by performing three or four stages:

- heating the raw material or tube, preferably a cylindrical steel tube;
- three-stage forging the portion of the partially heated tube meant to be changed;
- deburring the scrap produced and
- optional controlled cooling of the forged part.

The first stage for obtaining a part by a hot steel forging process in horizontal press covers heating the tube, preferably a cylindrical steel tube. In a preferred embodiment, the raw material as a tube, preferably a cylindrical steel tube, is partially heated in an electric induction oven. Thus, only the length of the tube, preferably a cylindrical steel tube, which is intended to deform by hot steel forging in horizontal press is heated, the remainder portions remaining unchanged since being very close to room temperature.

During this first stage, the time and end heating temperature are monitored and adjusted according to the intended configuration of the final part. This monitoring is particularly important, since it ensures the uniformity of the process both in subsequent deformation of the raw material and in the chemical composition of the final part. In order to obtain the necessary deformation of the raw material, it is heated to a temperature ranging 1300-1400° C.

The second step of the hot steel forging process in horizontal press consists in forging the raw material or partially heated cylindrical steel tube. During this stage the following stamping steps must be performed:

increasing the diameter, thickness or diameter or thickness of the partially heated cylindrical steel tube;

bringing it closer to the final geometry of the part; and stamping the part to its final geometry.

The increase in the diameter, thickness, or the diameter and thickness of the partially heated cylindrical steel tube takes place in order to facilitate the subsequent shaping of the part. Thus, the partially heated cylindrical steel tube is subjected to radial deformation in order to obtain a diameter difference close to that of the intended final part, this difference ranging from 1.5-2.5 times the original size, in particular ranging between 1.5-2.5 times the diameter, thickness, or the diameter and thickness of the starting tube, however the various operations must be controlled to prevent defective or with lower mechanical stiffness products, etc. . . . . In cases where the diameter of the cylindrical steel tube is close to the diameter intended to be deformed, this first step—diameter increase of the partially heated cylindrical steel tube—can be avoided. In cases where the thickness of the cylindrical steel tube is close to the thickness intended to be deformed, this first step—thickness increase of the partially heated cylindrical steel tube—can be avoided.

The second step of the stage for forging the partially heated cylindrical steel tube is characterized by bringing it closer to the final geometry, distributing it into the correct proportion so as to perfectly fill in in the third step. In this step the concentricity of the tool is essential so that the material is distributed properly, thereby avoiding subsequent problems with burrs or filling flaws.

In the third step of the stage for forging the partially heated cylindrical steel tube, the tool has the geometry of the final part, thereby allowing the intended part to be obtained after stamping in this position. In order to obtain a deformation as perfect as possible while simultaneously avoiding premature wear of the tool, the three operations must be performed within a period not exceeding preferably 180 seconds, preferably 120 seconds, preferably not exceeding 60 seconds, or even more preferably not exceeding 15 seconds.

Thus, by performing of the steps characterizing the forging stage, forging of the raw material, or the partially heated cylindrical steel tube, the partially heated cylindrical steel tube is subjected to three different pressings/deformations/stamping up to the obtention of the final part. These deformations are obtained by closing a tool with three different dies, caused by movement of a horizontal press. Thus, the final part is obtained after the starting cylindrical steel tube undergoing the three different positions of the tool, within a time which should preferably be less than 180 seconds, less than 120 seconds, less than 60 seconds, less than 30 seconds or less than 15 seconds.

In a preferred embodiment, the deburring stage may be optional and may be performed when removal of the scrap produced during the previous steps is required.

In a preferred embodiment, the cooling stage of the hot steel forging process in horizontal press may be optional. The cooling is controlled after forging operation, the part is removed from the tool at about 900° C., and depending on subsequent operations, and the part is cooled according to the applicability thereof.

In a preferred embodiment, the controlled cooling of the part has also the function of avoiding a subsequent heat treatment of the part, should the required mechanical properties be provided by cooling. Defining the cooling process depends on the quality of the raw material, part size and, as mentioned above, the applicability thereof.

In a preferred embodiment, the cooling process is defined by controlling the temperatures at a cooling tunnel inlet and outlet. Since this part shall be subsequently machined, cooling the part is intended to be slow, so as to cause normalization. For this purpose, the tunnel conveyor belt speed is caused to vary between 5-20 m/h, preferably 10-15 m/h and the flow rate of forced air flow passing therethrough may vary between 100-300 $m^3$/h preferably 120-290 $m^3$/h, and combinations thereof. The definition of these parameters is validated through multiple destructive and non-destructive mechanical testing of the parts after the cooling step.

Although the present disclosure has only shown and described particular embodiments of the solution, one skilled in the art shall know how to introduce modifications and replace some technical features for equivalents, depending on the requirements of each situation, without departing from the scope of protection defined by the appended claims.

The embodiments presented are combinable. The following claims set out particular embodiments of the disclosure.

The invention claimed is:

1. A forging process for obtaining a part from changing of a metal tube shape, wherein a portion of the part to be obtained is 2 to 2.1 times the a diameter and thickness of the metal tube, comprising the following steps:

heating a portion of the metal tube meant to be changed in shape to have an end heating temperature between 1300° C. and 1400° C.;

pressing the heated portion for bringing the heated portion closer to a pre-defined geometry of the part to be obtained; and subjecting the heated and pressed portion of the part to a second pressing for obtaining the portion of the part to be obtained with the pre-defined geometry of the part to be obtained;

subjecting the heated and pressed portion of the part to a third pressing for obtaining the portion of the part to be obtained with the pre-defined geometry of the part to be obtained;

selectively subjecting the heated and pressed portion of the part to a fourth pressing for obtaining the portion of the part to be obtained with the pre-defined geometry of the part to be obtained;

wherein the pressing is performed by a horizontal-type press, wherein the partially heated metal tube is subject to radial deformation to obtain a difference ranging from 2 to 2.1 times of the diameter, or thickness, or the diameter and the thickness of the metal tube to be changed in shape, wherein the metal tube is a steel tube, wherein the partial heating of the steel tube is made in an electric induction oven, and wherein forging the partially heated steel tube is carried out in 60 seconds.

2. The forging process according to claim 1, wherein the metal tube is a cylinder.

3. The forging process according to claim 1, further comprising a controlled cooling of the metal tube.

4. The forging process according to claim 3, wherein the controlled cooling of the steel tube at a temperature between 900-1000° C.

5. The forging process according to claim 3, further comprising passing the part through a cooling tunnel with a speed variation of a conveyor belt and a flow rate variation of forced air passing therethrough.

6. The forging process according to claim 3, further comprising passing the part through a cooling tunnel on a conveyor belt, wherein the conveyor belt speed varies between 5-20 m/h.

7. The forging process according to claim 3, further comprising passing the part through a cooling tunnel wherein the flow rate of air charged inside the tunnel varies between 100-300 $m^3$/h.

* * * * *